US008010351B2

(12) United States Patent
Gao

(10) Patent No.: US 8,010,351 B2
(45) Date of Patent: Aug. 30, 2011

(54) SPEECH CODING SYSTEM TO IMPROVE PACKET LOSS CONCEALMENT

(75) Inventor: Yang Gao, Mission Viejo, CA (US)

(73) Assignee: Yang Gao, Mission Viejo, CA (US)

( * ) Notice: Subject to any disclaimer, the term of this patent is extended or adjusted under 35 U.S.C. 154(b) by 953 days.

(21) Appl. No.: 11/942,118

(22) Filed: Nov. 19, 2007

(65) Prior Publication Data

US 2008/0154588 A1 Jun. 26, 2008

Related U.S. Application Data

(60) Provisional application No. 60/877,171, filed on Dec. 26, 2006.

(51) Int. Cl.
*G10L 19/12* (2006.01)

(52) U.S. Cl. ..... 704/207

(58) Field of Classification Search ..... 704/207
See application file for complete search history.

(56) References Cited

U.S. PATENT DOCUMENTS 6,556,966 B1 * 4/2003 Gao ..... 704/220
6,714,907 B2 * 3/2004 Gao ..... 704/220
7,117,146 B2 * 10/2006 Gao ..... 704/200.1

* cited by examiner

*Primary Examiner* — Susan McFadden

(57) ABSTRACT

A speech coding method of significantly reducing error propagation due to voice packet loss, while still greatly profiting from a pitch prediction or Long-Term Prediction (LTP), is achieved by limiting or reducing a pitch gain only for the first subframe or the first two subframes within a speech frame. The method is used for a speech class decided by a classification algorithm; the classification algorithm is designed, depending on at least one pitch cycle length compared to one subframe size. Speech coding quality loss due to the pitch gain reduction is compensated by increasing a coded excitation codebook size or adding one more stage of excitation only for the first subframe or the first two subframes within the speech frame.

12 Claims, 6 Drawing Sheets

Initial CELP Speech Encoder

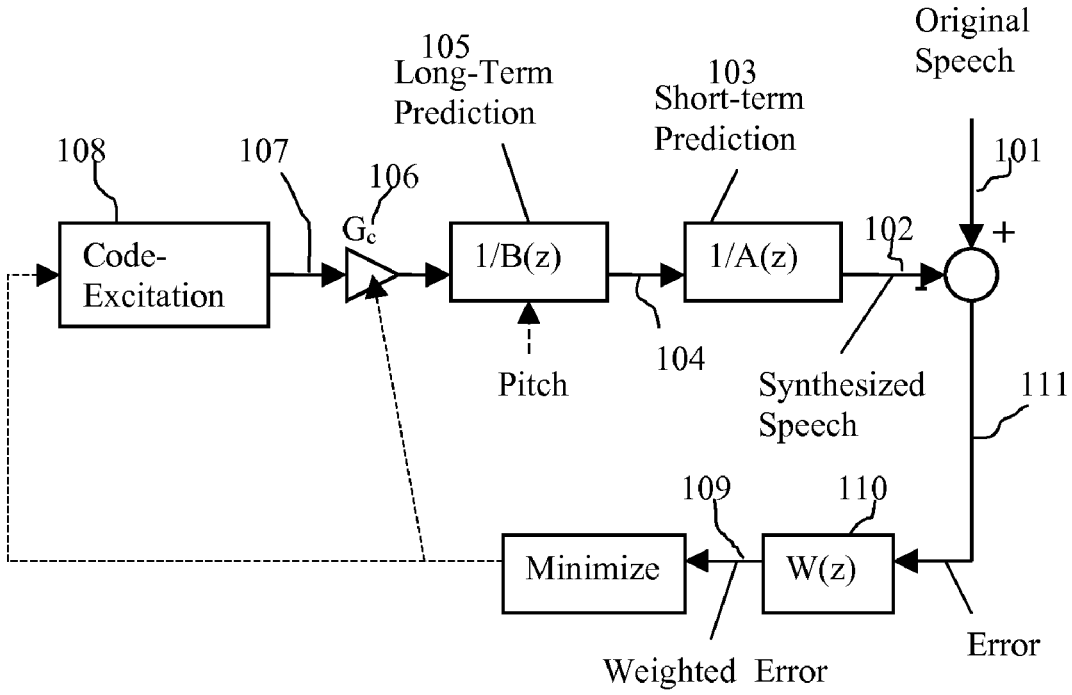
FIG. 1 Initial CELP Speech Encoder

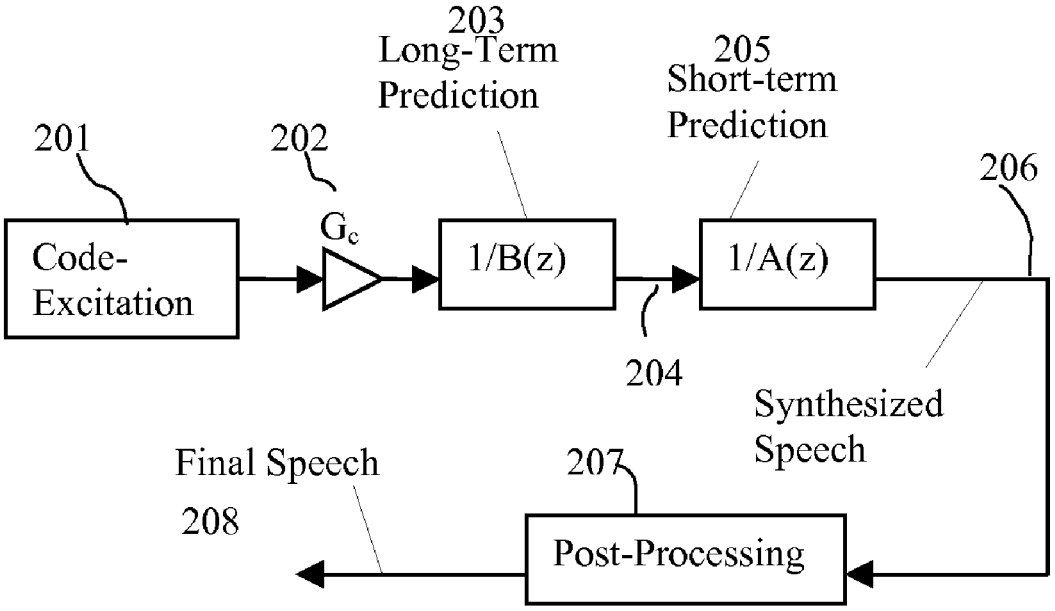
FIG. 2 Initial CELP Speech Decoder

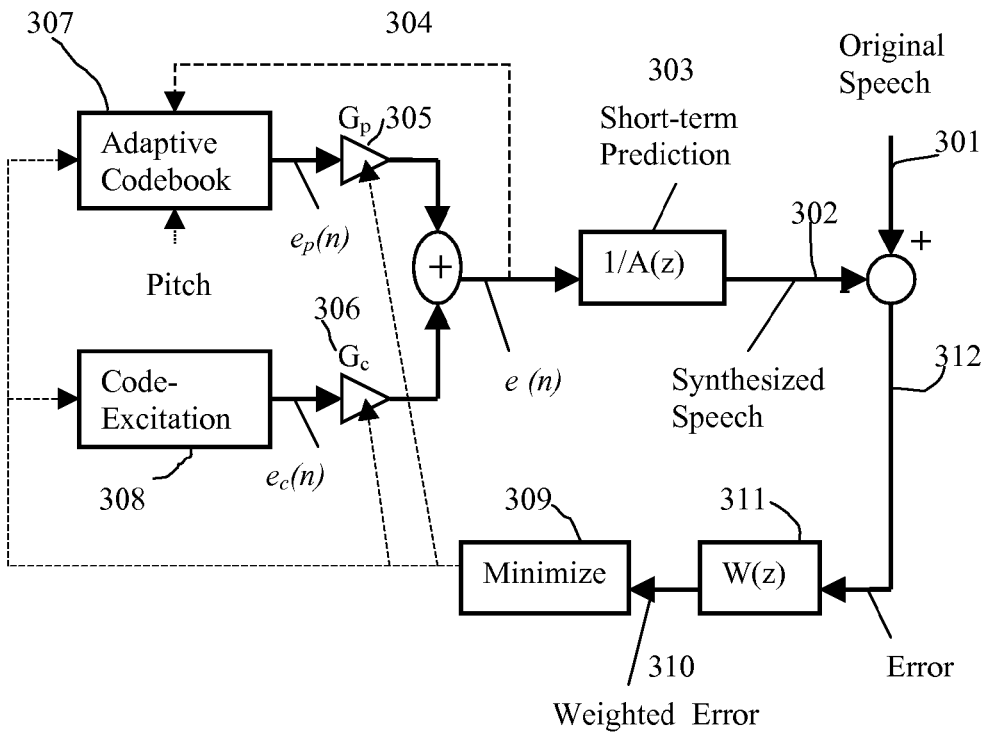
FIG.3 Basic CELP Speech Encoder

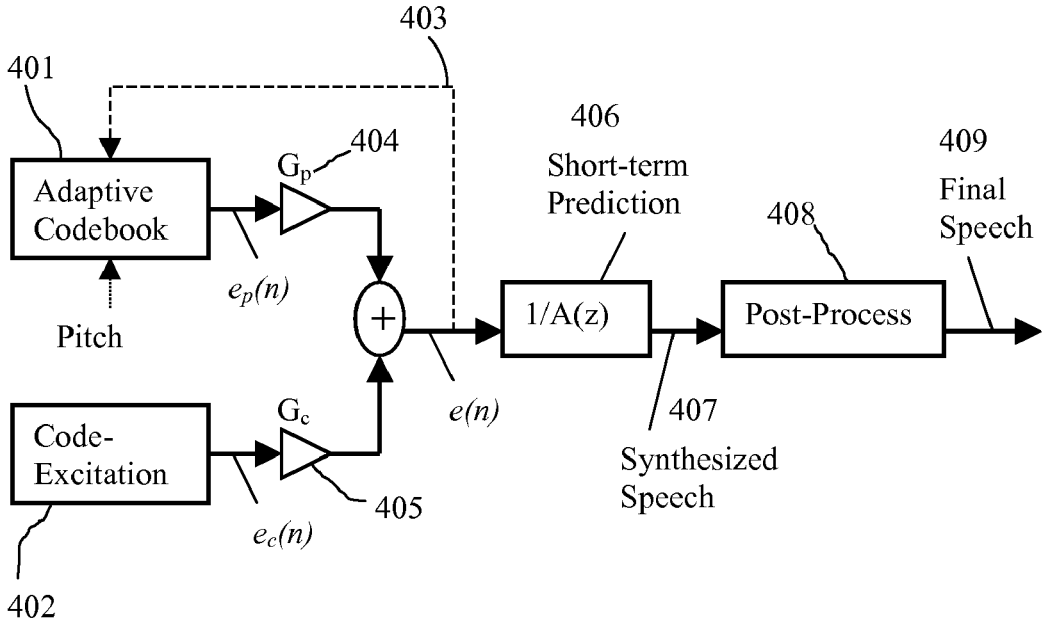
FIG.4 Basic CELP Speech Decoder

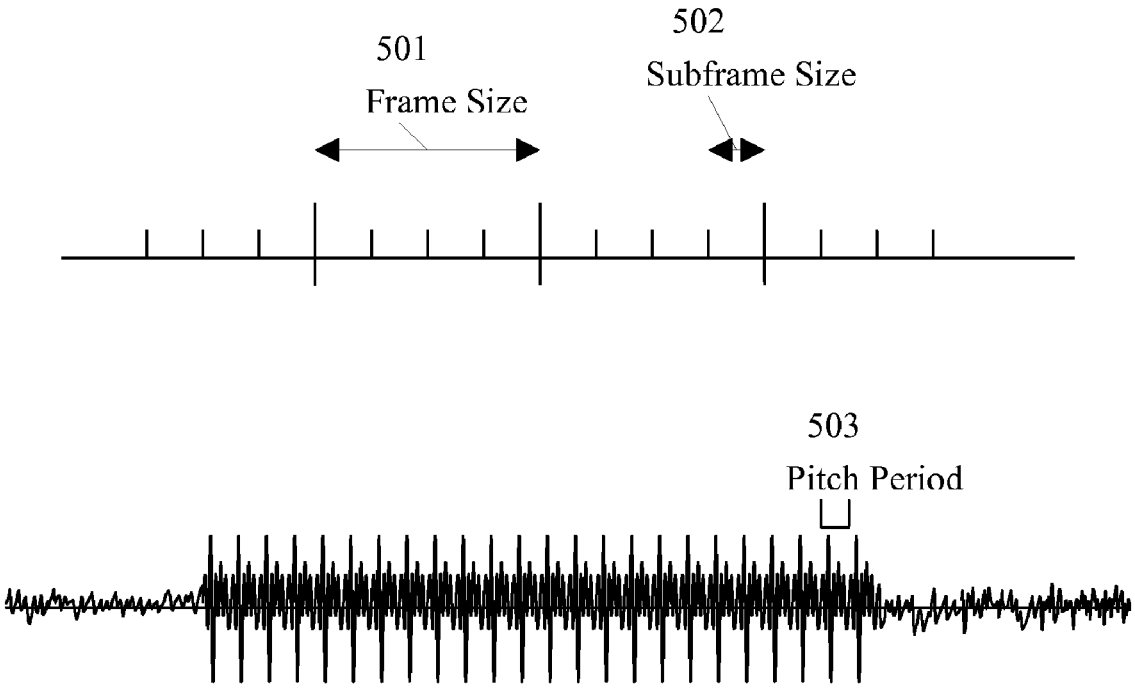
FIG. 5 Example for (Pitch<=Subframe Size)

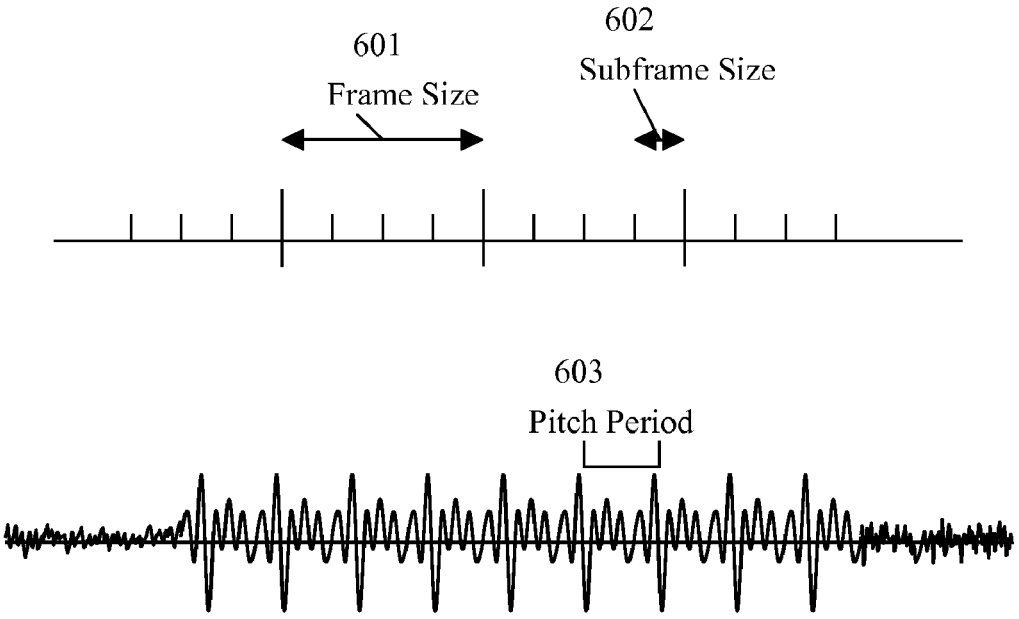
FIG. 6 Example for (Pitch>Subframe Size) & (Pitch<=Half Frame Size)

SPEECH CODING SYSTEM TO IMPROVE PACKET LOSS CONCEALMENT

CROSS REFERENCE TO RELATED APPLICATIONS

Provisional Application Number US60/877,172
Provisional Application Number US60/877,173

BACKGROUND OF THE INVENTION

1. Field of the Invention

The present invention is generally in the field of signal coding. In particular, the present invention is in the field of speech coding and specifically in application where packet loss is an important issue during voice packet transmission.

2. Background Art

Traditionally, all parametric speech coding methods make use of the redundancy inherent in the speech signal to reduce the amount of information that must be sent and to estimate the parameters of speech samples of a signal at short intervals. This redundancy primarily arises from the repetition of speech wave shapes at a quasi-periodic rate, and the slow changing spectral envelop of speech signal.

The redundancy of speech wave forms may be considered with respect to several different types of speech signal, such as voiced and unvoiced. For voiced speech, the speech signal is essentially periodic; however, this periodicity may be variable over the duration of a speech segment and the shape of the periodic wave usually changes gradually from segment to segment. A low bit rate speech coding could greatly benefit from exploring such periodicity. The voiced speech period is also called pitch and pitch prediction is often named Long-Term Prediction. As for the unvoiced speech, the signal is more like a random noise and has a smaller amount of predictability.

In either case, parametric coding may be used to reduce the redundancy of the speech segments by separating the excitation component of the speech from the spectral envelop component. The slowly changing spectral envelope can be represented by Linear Prediction (also called Short-Term Prediction). A low bit rate speech coding could also benefit a lot from exploring such a Short-Term Prediction. The coding advantage arises from the slow rate at which the parameters change. Yet, it is rare for the parameters to be significantly different from the values held within a few milliseconds. Accordingly, at the sampling rate of 8 k Hz or 16 k Hz, the speech coding algorithm is such that the nominal frame duration is in the range of ten to thirty milliseconds. A frame duration of twenty milliseconds seems to be the most common choice. In more recent well-known standards such as G.723, G.729, EFR or AMR, the Code Excited Linear Prediction Technique ("CELP") has been adopted; CELP is commonly understood as a technical combination of Coded Excitation, Long-Term Prediction and Short-Term Prediction. Code-Excited Linear Prediction (CELP) Speech Coding is a very popular algorithm principle in speech compression area.

FIG. 1 shows the initial CELP encoder where the weighted error 109 between the synthesized speech 102 and the original speech 101 is minimized by using a so-called analysis-by-synthesis approach. W(z) is the weighting filter 110. 1/B(z) is a long-term linear prediction filter 105; 1/A(z) is a short-term linear prediction filter 103. The code-excitation 108, which is also called fixed codebook excitation, is scaled by a gain $G_c$ 107 before going through the linear filters.

FIG. 2 shows the initial decoder which adds the post-processing block 207 after the synthesized speech.

FIG. 3 shows the basic CELP encoder which realized the long-term linear prediction by using an adaptive codebook 307 containing the past synthesized excitation 304. The periodic information of pitch is employed to generate the adaptive component of the excitation. This excitation component is then scaled by a gain $G_p$ 305 (also called pitch gain). The two scaled excitation components are added together before going through the short-term linear prediction filter 303. The two gains ($G_p$ and $G_c$) need to be quantized and then sent to the decoder.

FIG. 4 shows the basic decoder, corresponding to the encoder in FIG. 3, which adds the post-processing block 408 after the synthesized speech.

Long-Term Prediction plays very important role for voiced speech coding because voiced speech has strong periodicity. The adjacent pitch cycles of voiced speech are similar each other, which means mathematically the pitch gain $G_p$ in the following excitation express is very high, $$e(n)=G_p \cdot e_p(n)+G_c \cdot e_c(n) \tag{1}$$

where $e_p(n)$ is one subframe of sample series indexed by n, coming from the adaptive codebook 307 which consists of the past excitation 304; $e_c(n)$ is from the coded excitation codebook 308 (also called fixed codebook) which is the current excitation contribution. For voiced speech, the contribution of $e_p(n)$ from the adaptive codebook could be dominant and the pitch gain $G_p$ 305 is around a value of 1. The excitation is usually updated for each subframe. Typical frame size is 20 milliseconds and typical subframe size is 5 milliseconds. If the previous bit-stream packet is lost and the pitch gain $G_p$ is high, the incorrect estimate of the previous synthesized excitation could cause error propagation for quite long time after the decoder has already received the correct bit-stream packet. The partial reason of this error propagation is that the phase relationship between $e_p(n)$ and $e_c(n)$ has been changed due to the previous bit-stream packet loss. One simple solution to solve this issue is just to completely cut (remove) the pitch contribution between frames; this means the pitch gain $G_p$ is set to zero in the encoder. Although this kind of solution solved the error propagation problem, it sacrifices too much the quality when there is no bit-stream packet loss or it requires much higher bit rate to achieve the same quality. The invention explained in the following will provide a compromised solution.

SUMMARY OF THE INVENTION

In accordance with the purpose of the present invention as broadly described herein, there is provided method and system for speech coding.

For most voiced speech, one frame contains more than 2 pitch cycles. If the speech is very voiced, a compromised solution to avoid the error propagation while still profiting from the significant long-term prediction is to limit the pitch gain maximum value for the first pitch cycle of each frame. We can classify speech signal into different cases and treat them differently. For example, Class 1 is defined as (strong voiced) and (pitch<=subframe size); Class 2 is defined as (strong voiced) and (pitch>subframe & pitch<=half frame); Class 3 is defined as (strong voiced) and (pitch>half frame); Class 4 represents all other cases. In case of Class 1, Class 2, or Class 3, for the subframes which cover the first pitch cycle within the frame, the pitch gain is limited to a maximum value (depending on Class) much smaller than 1, and the coded excitation codebook size should be larger than other subframes within the same frame, or one more stage of code-excitation is added to compensate for the lower pitch gain. For other subframes rather than the first pitch cycle subframes, or for Class 4, a regular CELP algorithm is used. The Class index (class number) assigned above to each defined class can be changed without changing the result.

BRIEF DESCRIPTION OF THE DRAWINGS

The features and advantages of the present invention will become more readily apparent to those ordinarily skilled in the art after reviewing the following detailed description and accompanying drawings, wherein:

FIG. 1 shows the initial CELP encoder.

FIG. 2 shows the initial decoder which adds the post-processing block.

FIG. 3 shows the basic CELP encoder which realized the long-term linear prediction by using an adaptive codebook.

FIG. 4 shows the basic decoder corresponding to the encoder in FIG. 3.

FIG. 5 shows an example that the pitch period is smaller than the subframe size.

FIG. 6 shows an example with which the pitch period is larger than the subframe size and smaller than the half frame size.

DETAILED DESCRIPTION OF THE INVENTION

The present invention discloses a switched long-term pitch prediction approach which improves packet loss concealment. The following description contains specific information pertaining to the Code Excited Linear Prediction Technique (CELP). However, one skilled in the art will recognize that the present invention may be practiced in conjunction with various speech coding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention which use the principles of the present invention are not specifically described in the present application and are not specifically illustrated by the present drawings.

FIG. 1 shows the initial CELP encoder where the weighted error 109 between the synthesized speech 102 and the original speech 101 is minimized often by using a so-called analysis-by-synthesis approach. W(z) is an error weighting filter 110. 1/B(z) is a long-term linear prediction filter 105; 1/A(z) is a short-term linear prediction filter 103. The coded excitation 108, which is also called fixed codebook excitation, is scaled by a gain $G_c$ 107 before going through the linear filters. The short-term linear filter 103 is obtained by analyzing the original signal 101 and represented by a set of coefficients:

$$A(z) = \sum_{i=1}^{P} 1 + a_i \cdot z^{-i},\ i = 1, 2, \ldots, P \tag{1}$$

The weighting filter 110 is somehow related to the above short-term prediction filter. A typical form of the weighting filter could be $$W(z) = \frac{A(z/\alpha)}{A(z/\beta)}, \tag{2}$$

where $\beta<\alpha$, $0<\beta<1$, $0<\alpha\leqq 1$. The long-term prediction 105 depends on pitch and pitch gain; a pitch can be estimated from the original signal, residual signal, or weighted original signal. The long-term prediction function in principal can be expressed as $$B(z)=1-\beta\cdot z^{-Pitch} \tag{3}$$

The coded excitation 108 normally consists of pulse-like signal or noise-like signal, which are mathematically constructed or saved in a codebook. Finally, the coded excitation index, quantized gain index, quantized long-term prediction parameter index, and quantized short-term prediction parameter index are transmitted to the decoder.

FIG. 2 shows the initial decoder which adds the post-processing block 207 after the synthesized speech 206. The decoder is a combination of several blocks which are coded excitation 201, long-term prediction 203, short-term prediction 205 and post-processing 207. Every block except post-processing has the same definition as described in the encoder of FIG. 1. The post-processing could further consist of short-term post-processing and long-term post-processing.

FIG. 3 shows the basic CELP encoder which realized the long-term linear prediction by using an adaptive codebook 307 containing the past synthesized excitation 304. The periodic pitch information is employed to generate the adaptive component of the excitation. This excitation component is then scaled by a gain 305 ($G_p$, also called pitch gain). The two scaled excitation components are added together before going through the short-term linear prediction filter 303. The two gains ($G_p$ and $G_c$) need to be quantized and then sent to the decoder.

FIG. 4 shows the basic decoder corresponding to the encoder in FIG. 3, which adds the post-processing block 408 after the synthesized speech 407. This decoder is similar to FIG. 2 except the adaptive codebook 307. The decoder is a combination of several blocks which are coded excitation 402, adaptive codebook 401, short-term prediction 406 and post-processing 408. Every block except post-processing has the same definition as described in the encoder of FIG. 3. The post-processing could further consist of short-term post-processing and long-term post-processing.

FIG. 3 illustrates a block diagram of an example encoder capable of embodying the present invention. With reference to FIG. 3 and FIG. 4, the long-term prediction plays very important role for voiced speech coding because voiced speech has strong periodicity. The adjacent pitch cycles of voiced speech are similar each other, which means mathematically the pitch gain $G_p$ 305 in the following excitation express is very high, $$e(n)=G_p\cdot e_p(n)+G_c\cdot e_c(n) \tag{4}$$

where $e_p(n)$ is one subframe of sample series indexed by n, coming from the adaptive codebook 307 which consists of the past excitation 304; $e_c(n)$ is from the coded excitation codebook 308 (also called fixed codebook) which is the current excitation contribution. For voiced speech, the contribution of $e_p(n)$ from the adaptive codebook 307 could be dominant and the pitch gain $G_p$ 305 is around a value of 1. The excitation is usually updated for each subframe. Typical frame size is 20 milliseconds and typical subframe size is 5 milliseconds. If the previous bit-stream packet is lost and the pitch gain $G_p$ is high, the incorrect estimate of the previous synthesized excitation could cause error propagation for quite long time after the decoder has already received the correct bit-stream packet. The partial reason of this error propagation is that the phase relationship between $e_p(n)$ and $e_c(n)$ has been changed due to the previous bit-stream packet loss. One simple solution to solve this issue is just to completely cut (remove) the pitch contribution between frames; this means the pitch gain $G_p$ 305 is set to zero in the encoder. Although this kind of solution solved the error propagation problem, it sacrifices too much the quality when there is no bit-stream packet loss or it requires much higher bit rate to achieve the same quality. The invention explained in the following will provide a compromised solution.

For most voiced speech, one frame contains more than 2 pitch cycles. FIG. 5 shows an example that the pitch period 503 is smaller than the subframe size 502. FIG. 6 shows an example with which the pitch period 603 is larger than the subframe size 602 and smaller than the half frame size. If the speech is very voiced, a compromised solution to avoid the error propagation due to the transmission packet loss while still profiting from the significant long-term prediction gain is to limit the pitch gain maximum value for the first pitch cycle of each frame. We can classify speech signal into different cases and treat them differently. Let's have the following example in which valid speech is classified into 4 classes:

Class 1: (strong voiced) and (pitch<=subframe size). For this frame, the pitch gain of the first subframe is limited to a value (let's say 0.5) much smaller than 1. For the first subframe, the coded excitation codebook size should be larger than other subframes within the same frame, or one more stage of coded excitation is added only for the first subframe, in order to compensate for the lower pitch gain. For other subframes rather than the first subframe, a regular CELP algorithm is used. As this is a strong voiced frame, the pitch track and pitch gain are stable within the frame so that pitch and pitch gain can be encoded more efficiently with less number of bits.

Class 2: (strong voiced) and (pitch>subframe & pitch<=half frame). For this frame, the pitch gains of the first two subframes (half frame) are limited to a value (let's say 0.5) much smaller than 1. For the first two subframes, the coded excitation codebook size should be larger than other subframes within the same frame, or one more stage of code-excitation is added only for the first half frame, in order to compensate for the lower pitch gains. For other subframes rather than the first two subframes, a regular CELP algorithm is used. As this is a strong voiced frame, the pitch track and pitch gain are stable within the frame so that they can be coded more efficiently with less number of bits.

Class 3: (strong voiced) and (pitch>half frame). When the pitch lag is long, the error propagation effect due to the long-term prediction is less significant than short pitch lag case. For this frame, the pitch gains of the subframes covering the first pitch cycle are limited to a value smaller than 1; the coded excitation codebook size could be larger than regular size, or one more stage of coded excitation is added, in order to compensate for the lower pitch gains. Since long pitch lag causes the less error propagation and the probability of having long pitch lag is relatively small, just a regular CELP algorithm can be also used for the entire frame. As this is strong voiced frame, the pitch track and pitch gain are stable within the frame so that they can be coded more efficiently with less number of bits.

Class 4: all other cases rather than Class 1 Class 2, and Class 3. For all the other cases (exclude Class 1, Class 2, and Class 3), a regular CELP algorithm can be used.

The class index (class number) assigned above to each defined class can be changed without changing the result. For example, the condition (strong voiced) and (pitch<=subframe size) can be defined as Class 2 rather than Class 1; the condition (strong voiced) and (pitch>subframe & pitch<=half frame) can be defined as Class 3 rather than Class 2; etc.

In general, the error propagation effect due to speech packet loss is reduced by adaptively diminishing pitch correlations at the boundary of speech frames while still keeping significant contributions from the long-term pitch prediction.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A speech coding computer implemented method of significantly reducing error propagation due to voice packet loss while still greatly profiting from a pitch prediction or Long-Term Prediction (LTP), the method comprising:

having an adaptive excitation component generated by multiplying a pitch gain (a scaling factor) with an adaptive vector produced from a past excitation with the pitch prediction;

having a coded excitation component;

adding the adaptive excitation component and the coded excitation component together to generate an excitation as an input to a Linear Prediction or Short-Term Prediction (STP) filter;

determining an initial value of the pitch gain for every subframe within a frame of speech signal by minimizing a coding error or a weighted coding error at an encoder;

reducing or limiting the value of the pitch gain to be smaller than the initial value of the pitch gain for the first subframe within the frame, in order to diminish impact of pitch correlations at the boundary of the frame when the voice packet loss happens;

keeping the value of the pitch gain to be equal to the initial value of the pitch gain for any other subframe rather than the first subframe within the frame so that the pitch prediction is still efficient;

encoding the pitch gain for every subframe of the frame at the encoder; and sending the encoded pitch gain for every subframe of the frame to a decoder.

2. The method of claim 1 further comprising the steps of:

limiting or reducing the value of the pitch gain of the first subframe to be smaller than 1;

generating the coded excitation component by multiplying a fixed codebook gain with a fixed codebook vector selected from a coded excitation codebook (a fixed codebook); and compensating for coding quality loss due to the pitch gain reduction by increasing the coded excitation codebook size for the first subframe to be larger than the coded excitation codebook size for any other subframe within the frame.

3. The method of claim 1 further comprising:

limiting or reducing the value of the pitch gain to be smaller than 0.5 for the first subframe rather than the other subframes within the frame; and compensating for coding quality loss due to the pitch gain reduction by adding one more stage of coded excitation to the coded excitation component for the first subframe rather than the other subframes within the frame.

4. The method of claim 1, wherein the initial value of the pitch gain and the coded excitation component are determined by minimizing a weighted coding error in an analysis-by-synthesis approach.

5. The method of claim 1, wherein the pitch gain limitation or reduction for the first subframe within the frame is employed for voiced speech and not for unvoiced speech.

6. A speech coding computer implemented method for encoding a speech signal and reducing error propagation due to voice packet loss, the method comprising:

a plurality of speech frames are classified into a plurality of classes by using a classification algorithm; and at least for one of the classes, the following steps are included:

an adaptive excitation component is generated by multiplying a pitch gain (a scaling factor) with an adaptive vector produced from a past excitation with a pitch prediction;

the adaptive excitation component and a coded excitation component are added together to generate an excitation as an input to a Linear Prediction or Short-Term Prediction (STP) filter;

an initial value of the pitch gain for every subframe within a speech frame is determined by minimizing a coding error or a weighted coding error at an encoder;

the value of the pitch gain is limited or reduced to be smaller than the initial value of the pitch gain for the first subframe (or the first two subframes) within the speech frame, in order to diminish impact of pitch correlations at the boundary of the speech frame when the voice packet loss happens;

the value of the pitch gain is kept to be equal to the initial value of the pitch gain for any other subframe rather than the first subframe (or the first two subframes) within the speech frame so that the pitch prediction is still efficient;

encoding the pitch gain for every subframe of the speech frame at the encoder; and sending the encoded pitch gain for every subframe of the speech frame to a decoder.

7. The method of claim 6 further comprising the steps of:

limiting or reducing the value of the pitch gain to be smaller than 1 for the first subframe (or the first two subframes) within the speech frame;

generating the coded excitation component by multiplying a fixed codebook gain with a fixed codebook vector selected from a coded excitation codebook (a fixed codebook); and compensating for coding quality loss due to the pitch gain reduction by increasing the coded excitation codebook size for the first subframe (or the first two subframes) to be larger than the coded excitation codebook size for any other subframe within the speech frame.

8. The method of claim 6 further comprising:

limiting or reducing the value of the pitch gain to be smaller than 0.5 for the first subframe (or the first two subframes) rather than the other subframes within the frame; and compensating for coding quality loss due to the pitch gain reduction by adding one more stage of coded excitation to the coded excitation component for the first subframe (or the first two subframes) rather than the other subframes within the frame.

9. The method of claim 6 wherein the initial value of the pitch gain and the coded excitation component are determined by minimizing a weighted coding error in an analysis-by-synthesis approach.

10. The method of claim 6, wherein one of the classes is a voiced speech class, and the pitch gain limitation or reduction for the first subframe (or the first two subframes) within the frame is employed only for the voiced speech class.

11. The method of claim 6 wherein the classification algorithm comprises a comparison between a pitch cycle length and a subframe size within a speech frame.

12. The method of claim 6 comprising a Code-Excited Linear Prediction (CELP) methodology.

* * * * *